US010704558B2

(12) United States Patent
Liang et al.

(10) Patent No.: US 10,704,558 B2
(45) Date of Patent: Jul. 7, 2020

(54) FAN HEAD PART, VERTICAL TYPE AND WALL-MOUNTED TYPE FANS, HOUSEHOLD APPLIANCE AND AIR BLOWING METHOD

(71) Applicants: GD MIDEA ENVIRONMENT APPLIANCES MFG CO., LTD., Dongfeng Zhongshan (CN); MIDEA GROUP CO., LTD., Foshan (CN)

(72) Inventors: Songhao Liang, Dongfeng Zhongshan (CN); Chen Shao, Dongfeng Zhongshan (CN)

(73) Assignees: GD MIDEA ENVIRONMENT APPLIANCES MFG. CO., LTD., Dongfeng Zhongshan (CN); MIDEA GROUP CO., LTD., Foshan (CN)

( * ) Notice: Subject to any disclaimer, the term of this patent is extended or adjusted under 35 U.S.C. 154(b) by 207 days.

(21) Appl. No.: 15/905,682

(22) Filed: Feb. 26, 2018

(65) Prior Publication Data

US 2018/0180051 A1 Jun. 28, 2018

Related U.S. Application Data

(63) Continuation of application No. PCT/CN2016/096162, filed on Aug. 22, 2016.

(30) Foreign Application Priority Data

Sep. 2, 2015 (CN) ..... 2015 1 0560817

(51) Int. Cl.

| | |
|---|---|
| ***F04D 25/08*** | (2006.01) |
| ***F04D 25/10*** | (2006.01) |
| ***F04D 25/06*** | (2006.01) |

(52) U.S. Cl.
CPC ..... *F04D 25/08* (2013.01); *F04D 25/06* (2013.01); *F04D 25/105* (2013.01)

(58) Field of Classification Search
CPC combination set(s) only.
See application file for complete search history.

(56) References Cited

U.S. PATENT DOCUMENTS

| | | | |
|---|---|---|---|
| 1,099,693 | A | 6/1914 | Diehl |
| 1,684,325 | A | 9/1928 | Lister et al. |

(Continued)

FOREIGN PATENT DOCUMENTS

| | | | |
|---|---|---|---|
| CN | 201225307 | Y | 4/2009 |
| CN | 201377455 | Y | 1/2010 |

(Continued)

OTHER PUBLICATIONS

GD Midea Environment Appliances Mfg. Co. Ltd., Extended European Search Report, EP16840746.8, dated May 11, 2018, 6 pgs.

(Continued)

*Primary Examiner* — Richard A Edgar
*Assistant Examiner* — Maxime M Adjagbe
(74) *Attorney, Agent, or Firm* — Morgan, Lewis & Bockius LLP

(57) ABSTRACT

Disclosed are a fan head part, a stand fan and a wall-mounted fan, a household appliance and an air blowing method. The fan head part comprises a base and a fan head, wherein the fan head comprises a blade and a grill, the blade being able to rotate with a first axis, the fan head being able to integrally rotate about a second axis and along a circumferential direction relative to the base, and the second axis extends through the grill in the front-rear direction and being obliquely arranged relative to the first axis. Since the second axis is obliquely arranged relative to the first axis, only one driving structure is required to simultaneously drive the fan (Continued)

head to rotate within a space defined in the horizontal and vertical directions, so that the structure is simple, and the costs are relatively low.

5 Claims, 10 Drawing Sheets

(56) References Cited

U.S. PATENT DOCUMENTS

| | | | | |
|---|---|---|---|---|
| 2,050,764 | A | 8/1936 | Rogers | |
| 2,635,275 | A | 4/1953 | Holtzclaw | |
| 2008/0069694 | A1* | 3/2008 | Hernandez | F04D 29/601 416/63 |
| 2008/0298968 | A1* | 12/2008 | Frampton | F04D 25/088 416/170 R |

FOREIGN PATENT DOCUMENTS

| | | | |
|---|---|---|---|
| CN | 203717400 | U | 7/2014 |
| CN | 105134631 | A | 12/2015 |
| DE | 1012425 | B | 7/1957 |
| JP | 30-006436 | | 9/1955 |
| KR | 20130085615 | A | 7/2013 |

OTHER PUBLICATIONS

Notice of Reasons for Refusal, JP2018-508681, dated Sep. 17, 2019, 8 pgs.

Notification of Reasons for Refusal, JP2018-508681, dated Jan. 17, 2019, 8 pgs.

GD Midea Environment Appliances Mfg. Co. Ltd., International Search Report and Written Opinion, PCT/CN2016/096162, dated Nov. 18, 2016, 22 pgs.

* cited by examiner

FAN HEAD PART, VERTICAL TYPE AND WALL-MOUNTED TYPE FANS, HOUSEHOLD APPLIANCE AND AIR BLOWING METHOD

PRIORITY CLAIM AND RELATED APPLICATION

This application is a continuation application of PCT/CN2016/096162, entitled "FAN HEAD PART, STAND FAN AND WALL-MOUNTED FANS, HOUSEHOLD APPLIANCE AND AIR BLOWING METHOD" filed on Aug. 22, 2016, which claims priority to Chinese Patent Application No. 201510560817.9, filed with the State Intellectual Property Office of the People's Republic of China on Sep. 2, 2015, both of which are incorporated herein by reference in their entirety.

TECHNICAL FIELD

The present disclosure relates to a technical field of household appliances, and more particularly to a fan head part, a stand fan, a wall-mounted fan, a household appliance and an air blowing method.

BACKGROUND

In the prior art, a head of a fan can pivot left and right as well as up and down by designing independent mechanisms in horizontal and vertical directions respectively. A fan head of each of CN203717400 U, CN104204536 A, CN203730360 U and CN 203847417 U can rotate within a space by an independent automatic swing mechanism and an independent automatic pitching mechanism, however the structure is complex and the cost is high.

SUMMARY

Embodiments of the present disclosure seek to solve at least one of the problems existing in the prior art to at least some extent. For that reason, the present disclosure needs to provide a fan head part.

The present disclosure also needs to provide a stand fan.

The present disclosure also needs to provide a wall-mounted fan.

The present disclosure also needs to provide a household appliance.

The present disclosure also needs to provide an air blowing method.

The fan head part according to embodiments of the present disclosure includes a base and a fan head, in which the fan head includes a blade and a grill, the blade is able to rotate about a first axis, the fan head is able to integrally rotate about a second axis and along a circumferential direction relative to the base, and the second axis extends through the grill in a front-rear direction and is obliquely arranged relative to the first axis.

For the fan head part according to embodiments of the present disclosure, the second axis is obliquely arranged relative to the first axis, such that just one drive structure can drive the fan head to rotate in a space defined by a horizontal direction and a vertical direction, and the structure is simple and the cost is low.

In some embodiments, an angle defined by a front portion of the first axis and a front portion of the second axis is 10° to 80°.

In some embodiments, the angle defined by the front portion of the first axis and the front portion of the second axis is 35° to 55°.

The stand fan according to embodiments of the present disclosure includes a base and a fan head, in which the fan head includes a blade, the blade is able to rotate about a first axis and the fan head is able to integrally rotate about a second axis and along a circumferential direction relative to the base, the front portion of the second axis is upwards oblique relative to a horizontal plane, and the stand fan is not provided with an independently automatic pitching mechanism.

In some embodiments, the stand fan is not provided with an independently automatic swing mechanism.

In some embodiments, the stand fan is just provided with two electric motors which are a first electric motor and a second electric motor respectively, the first electric motor is connected with the blade, and the second electric motor is connected with the fan head.

In some embodiments, the fan head is connected with a gear transmission mechanism or a linkage transmission mechanism.

The wall-mounted fan according to embodiments of the present disclosure includes a base and a fan head, in which the fan head includes a blade, a grill and a first rotating shaft, the first rotating shaft is used for driving the blade to rotate, the fan head is able to integrally rotate about a rotating axis and along a circumferential direction relative to the base, and the rotating axis extends through the grill and is obliquely arranged relative to the first rotating shaft.

The household appliance according to embodiments of the present disclosure includes a movable portion and a fixing portion, in which the movable portion includes a grill, the movable portion is able to integrally rotate about a rotating axis and along a circumferential direction relative to the fixing portion, the rotating axis penetrates the grill and is obliquely arranged relative to a central line of the grill of the movable portion, the household appliance is not provided with an independently automatic pitching mechanism.

The air blowing method for a fan according to embodiments of the present disclosure is provided. The fan includes a fan head, the fan head includes a blade and a grill. The air blowing method includes the following steps:

the blade of the fan head rotating about a first axis, so as to produce air flow; and the fan head integrally rotating along a circumferential direction relative to a second axis, in which the second axis extends through the grill in a front-rear direction and is obliquely arranged relative to the first axis.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

DETAILED DESCRIPTION

Figure 1:
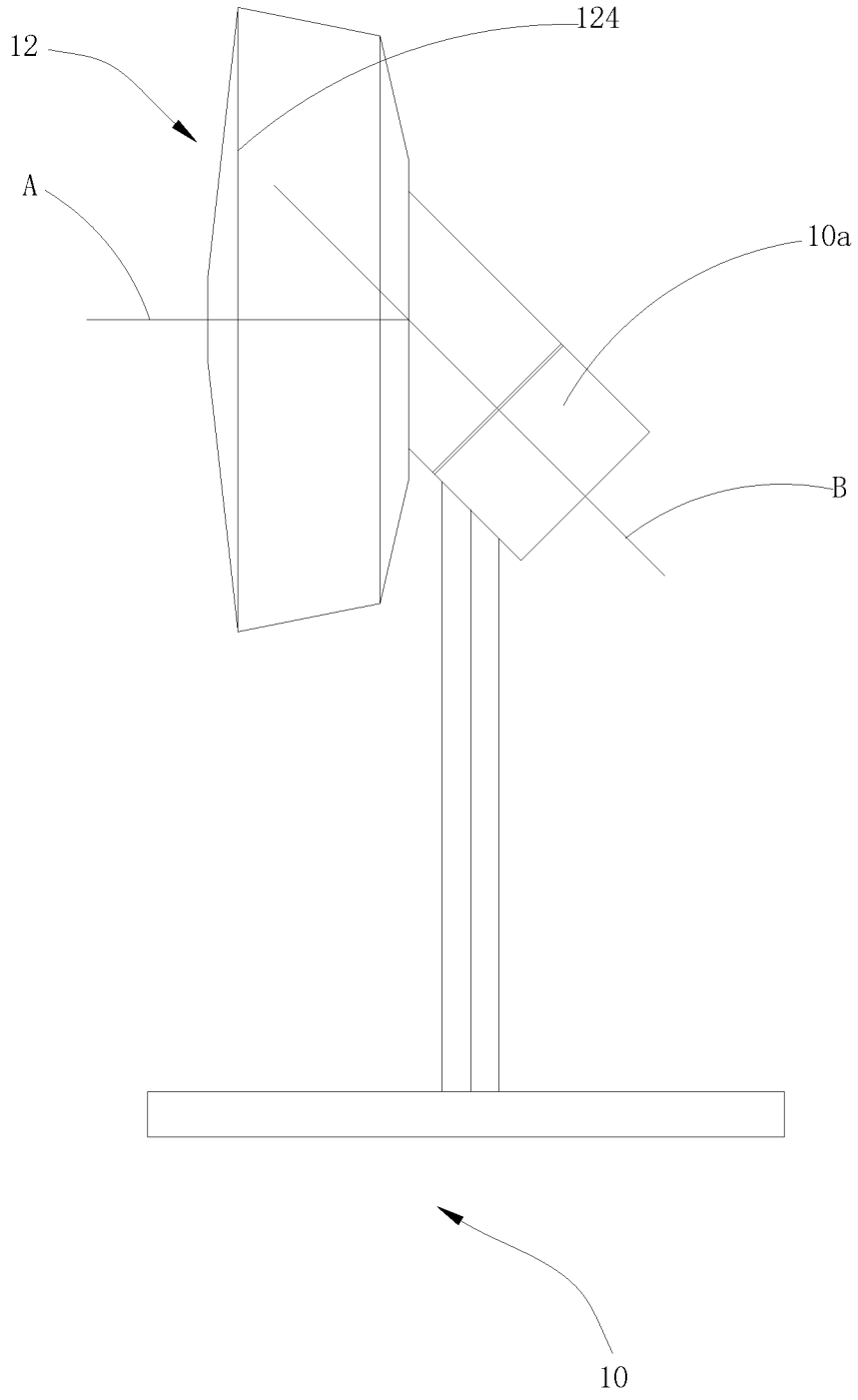
FIG. 1 is a schematic view of a stand fan according to embodiments of the present disclosure.
Figure 2:
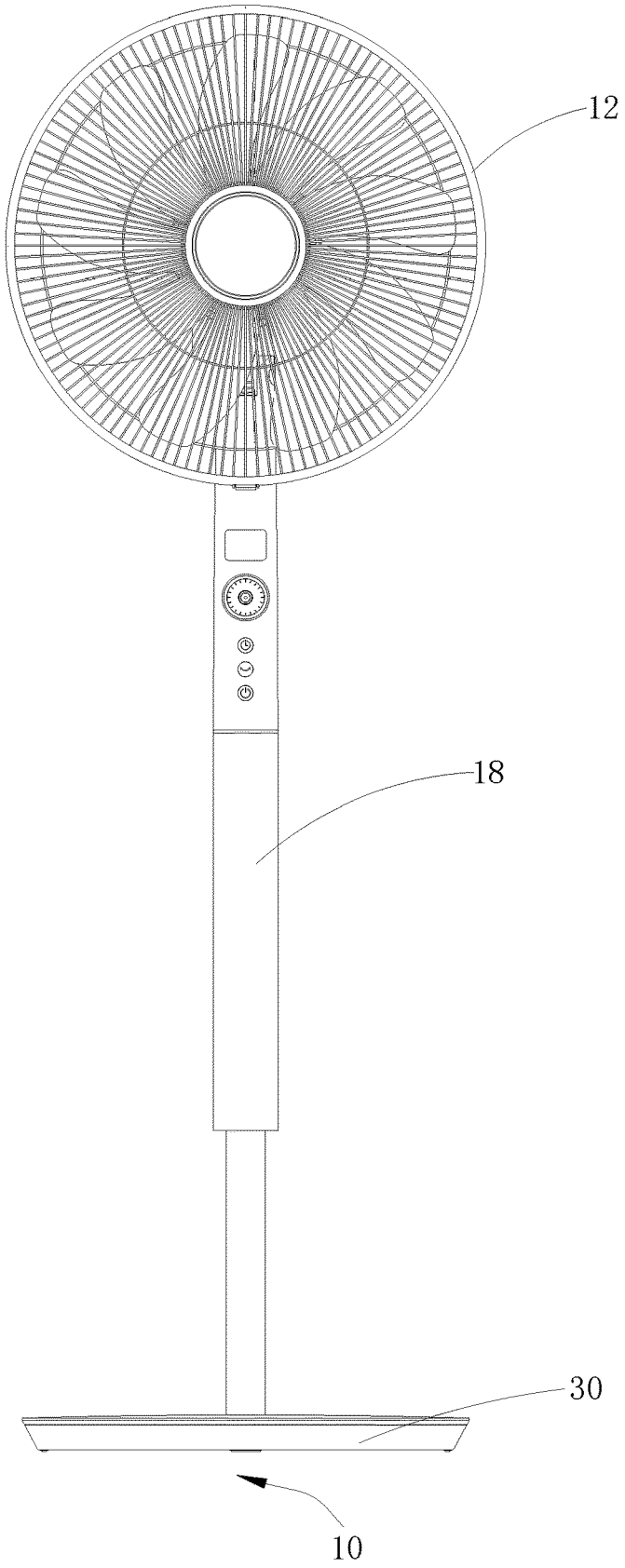
FIG. 2 is a front view of a fan according to embodiments of the present disclosure.
Figure 3:
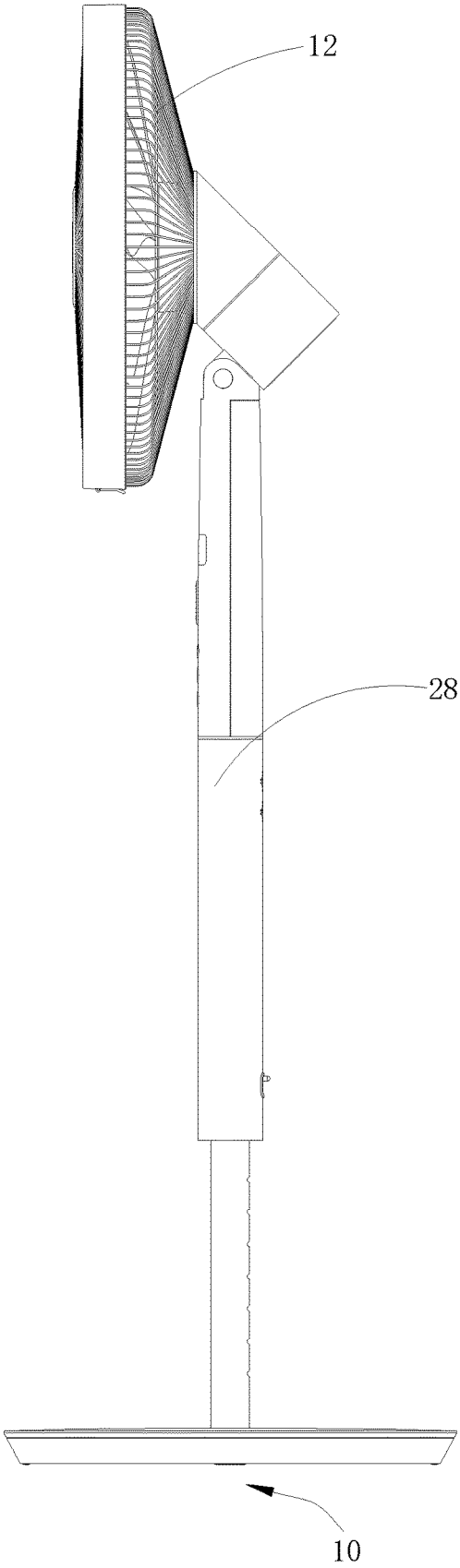
FIG. 3 is a lateral view of a fan according to embodiments of the present disclosure.
Figure 4:
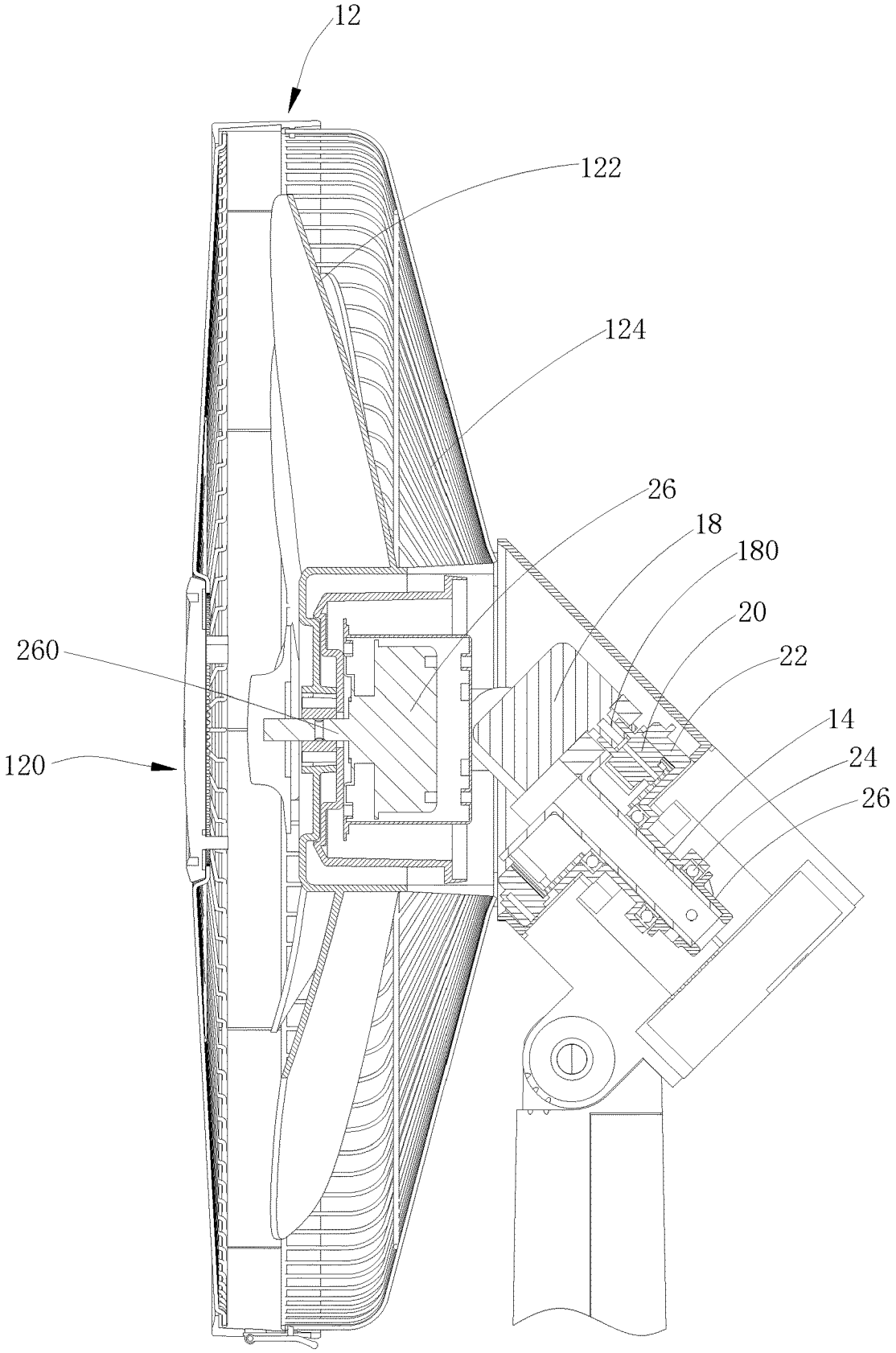
FIG. 4 is a laterally sectional view of a fan head of a fan according to embodiments of the present disclosure.
Figure 5:
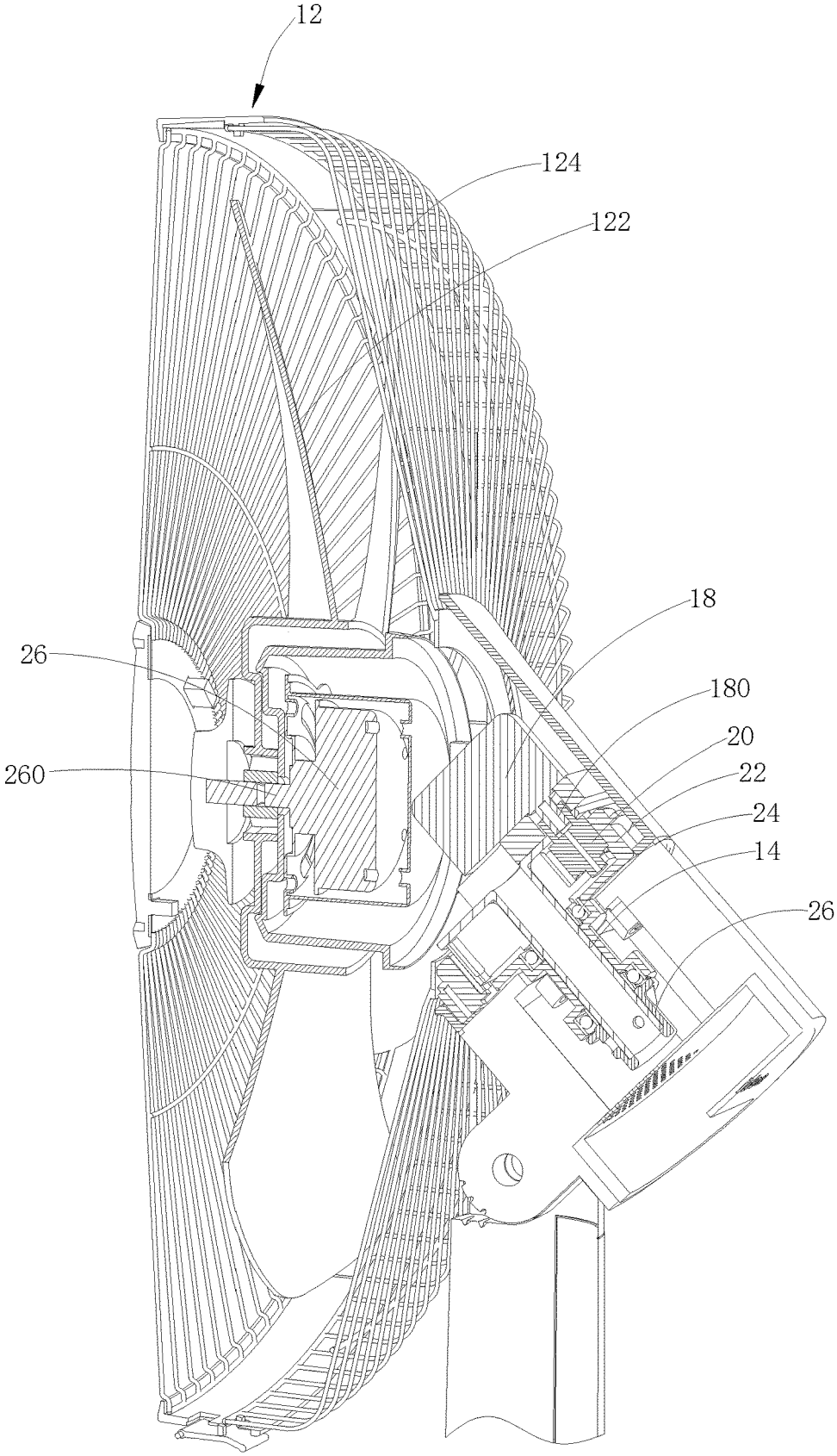
FIG. 5 is another laterally sectional view of a fan head of a fan according to embodiments of the present disclosure.
Figure 6:
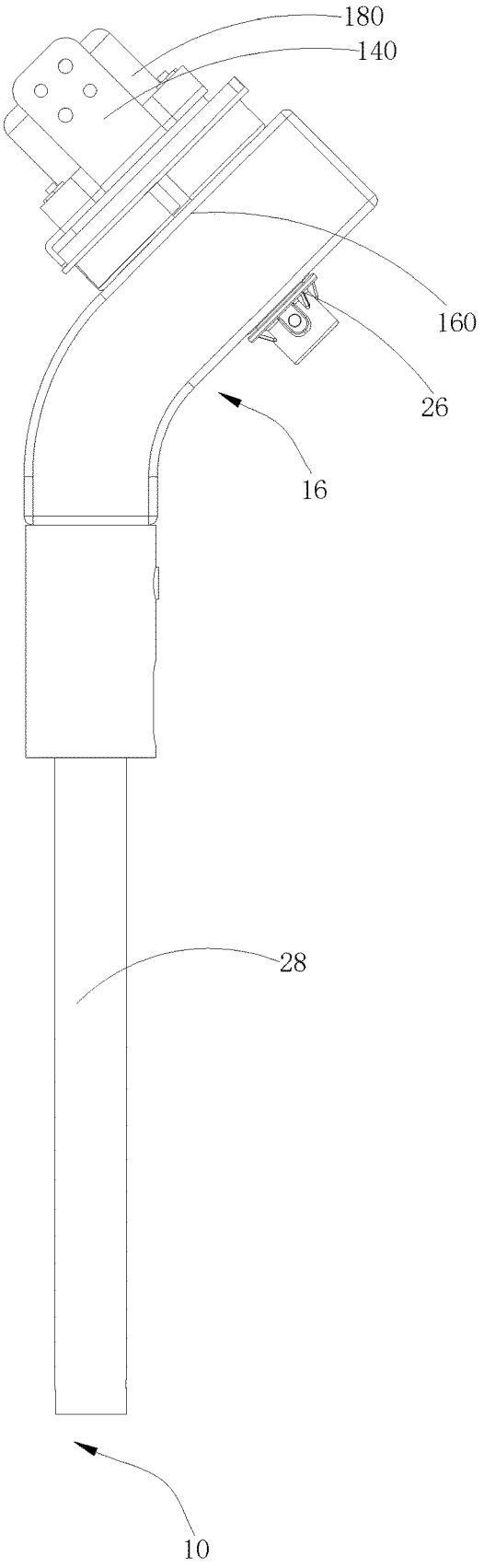
FIG. 6 is a schematic view of a stand pillar portion of a fan according to embodiments of the present disclosure.

Reference will be made in detail to embodiments of the present disclosure. Examples of the embodiments are shown in the drawings. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, the term "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

Various embodiments and examples are provided in the following description to implement different structures of the present disclosure. In order to simplify the present disclosure, certain elements and settings will be described. However, these elements and settings are only by way of example and are not intended to limit the present disclosure. In addition, reference numerals may be repeated in different examples in the present disclosure. This repeating is for the purpose of simplification and clarity and does not refer to relations between different embodiments and/or settings. Furthermore, examples of different processes and materials are provided in the present disclosure. However, it would be appreciated by those skilled in the art that other processes and/or materials may be also applied.

Reference will be made in detail to embodiments of the present disclosure. Examples of the embodiments are shown in the drawings. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, the term "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

Various embodiments and examples are provided in the following description to implement different structures of the present disclosure. In order to simplify the present disclosure, certain elements and settings will be described. However, these elements and settings are only by way of example and are not intended to limit the present disclosure. In addition, reference numerals may be repeated in different examples in the present disclosure. This repeating is for the purpose of simplification and clarity and does not refer to relations between different embodiments and/or settings. Furthermore, examples of different processes and materials are provided in the present disclosure. However, it would be appreciated by those skilled in the art that other processes and/or materials may be also applied.

Referring to FIG. 1, a fan head part 10 according to a first embodiment of the present disclosure includes a base 10*a* and a fan head 12. The fan head 12 includes a blade 122 and a grill 124. The blade 122 can rotate about a first axis A. The fan head 12 can integrally rotate about a second axis B and along a circumferential direction relative to the base 10*a*. The second axis B extends through the grill 124 in a front-rear direction and is obliquely arranged relative to the first axis A.

For the fan head part according to embodiments of the present disclosure, the second axis B is obliquely arranged relative to the first axis A, such that just one drive structure can drive the fan head 12 to rotate within a space defined by a horizontal direction and a vertical direction, achieving a simple structure and low cost.

In the present embodiment, an angle defined by a front portion of the first axis A and a front portion of the second axis B is 10° to 80°.

In this way, just one drive structure can drive the fan head 12 to rotate within the space defined by the horizontal direction and the vertical direction, achieving a simple structure and low cost.

In the present embodiment, the angle defined by the front portion of the first axis A and the front portion of the second axis B is 35° to 55°. More preferably, the angle between them is 45°.

In this way, the fan head 12 can rotate in a slanting plane at a certain angle relative to the horizontal plane, such that the fan 10 can achieve rotation and wind guide in a wider angle. A rotation angle can be 360°, or less than 360°, and the fan 10 can rotate clockwise and anti-clockwise in reciprocation, or can circularly rotate in one direction.

Referring to FIGS. 2 to 6, a stand fan 10 according to the first embodiment of the present disclosure includes the base 10*a* and the fan head 12. The fan head includes the blade 122. The blade 122 can rotate about the first axis A, and the fan head 12 can integrally rotate about the second axis B and along the circumferential direction relative to the base 10*a*. The front portion of the second axis B is upwards oblique relative to the horizontal plane. The stand fan 10 is not provided with an independently automatic pitching mechanism.

In this way, the second axis B is obliquely arranged relative to the first axis A, such that just one drive structure can drive the fan head 12 to rotate within the space defined by the horizontal direction and the vertical direction, achieving a simple structure and low cost.

In the present embodiment, the stand fan 10 is not provided with an independently automatic swing mechanism.

In this way, the structure is simple and the production cost is lowered.

In the present embodiment, the stand fan 10 is just provided with two electric motors, i.e. a first electric motor and a second electric motor. The first electric motor 26 is connected with the blade, and the second electric motor 18 is connected with the fan head.

In this way, the stand fan 10 can drive the fan head 12 to rotate within the space defined by the horizontal direction and the vertical direction only by means of the second electric motor 18, the structure is simple and the cost is low.

In the present embodiment, the fan head 12 is connected with a gear transmission mechanism or a linkage transmission mechanism. Thus, the structure is simple, firm and reliable.

In the present embodiment, the stand fan 10 includes a support 28 for supporting the fan head 12 and a bending portion 16 connecting the support 28 to the fan head 12. The support 28 extends in the vertical direction. The bending portion 16 includes a columnar mounting portion 160 located far away from the support 28. A central axis of the mounting portion 160 is obliquely arranged relative to the support 28. The second axis B is perpendicular to the central axis of the mounting portion 160. The mounting portion 160 is provided with a second rotating shaft 14, the second rotating shaft 14 is perpendicular to the central axis of the mounting portion 160. A third rotating shaft 180 of the second electric motor is connected to the second rotating shaft 14, thereby driving the second rotating shaft 14 to rotate.

In this way, by means of the inclined columnar mounting portion 160, the stand fan 10 achieves that the second axis B is obliquely arranged relative to the first axis A.

In the present embodiment, the stand fan 10 includes a first gear 20 and a second gear 22. The first gear 20 is connected with the third rotating shaft 180, the second gear 22 is connected with the second rotating shaft 14, and the second gear 22 is engaged with the first gear 20.

In this way, the second electric motor 18 drives the second rotating shaft 14 to rotate by means of the first gear 20 and the second gear 22.

Specifically, the second gear 22 is an internal gear. When the stand fan 10 starts a function of rotation, the second electric motor 18 drives the first gear 20 to move around the second gear 22, thus driving the second rotating shaft 14 to move, thereby finally driving the fan head 12 to move.

In the present embodiment, a bearing 24 is fitted over the second rotating shaft 14. Two bearings 24 are provided. The two bearings 24 are fitted over the second rotating shaft 14 and opposite to each other in the upper and lower. The bearing 24 is used for supporting the second rotating shaft 14, reducing friction when the second rotating shaft 14 is rotating.

In the present embodiment, a distal end of the second rotating shaft 14 is provided with a locking nut 26. The locking nut 26 abuts against the bearing 24, so as to fix the bearing 24 to the second rotating shaft 14, thereby preventing the bearing 24 from falling off.

In the present embodiment, in the stand fan 10, a rotating structure is constituted by the second rotating shaft 14, the bending portion 16, the second electric motor 18, the first gear 20, the second gear 22, the bearing 24 and the locking nut 26. The rotating structure is used for driving the fan head 12, such that the fan head 12 can achieve lateral rotation and up-down rotation at the same time.

Figure 7:
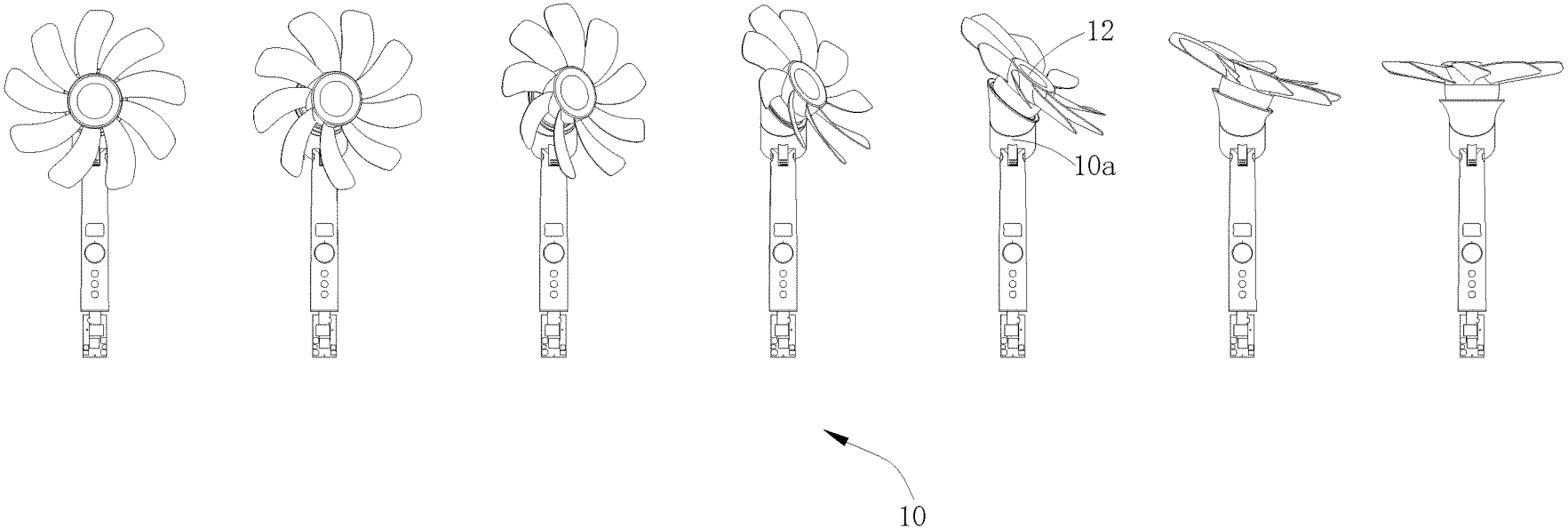
FIG. 7 shows a moving state of a stand fan according to embodiments of the present disclosure.

FIG. 7 illustrates a moving state of the stand fan 10 according to embodiments of the present disclosure. It can be seen from left to right in the drawing, the fan head 12 can rotate in the space, i.e., the fan head 12 can rotate in horizontal direction and in vertical direction at the same time.

The stand fan 10 according to embodiments of the present disclosure can drive the fan head 12 to rotate in the space only by means of one electric motor, thereby saving the design space. The structure is simple and easy to achieve, and the manufacture cost is low.

Specifically, the fan head 12 is substantially circular in shape. The fan head 12 includes the grill 121, the blade 122 received in the grill 121 and the first electric motor 26 for driving the blade 121 to rotate. A front side of the fan head 12 is provided with an air outlet side 120, the first rotating shaft 260 of the first electric motor 26 is perpendicular to the air outlet side 120 and is located at the central axis of the fan head 12. The third rotating shaft 180 of the second electric motor 18 is parallel to the second rotating shaft 14. The rotating shaft 14 extends to the two sides and forms a connecting portion 140. The connecting portion 140 is fixedly connected with the fan head 12. The second rotating shaft 14 is integrally formed with the connecting portion 140, which is a sheet metal part. For the stand fan 10, the support 28 is connected with the fan head 12, the support 28 is perpendicular to the horizontal plane, and the support 28 is connected with a chassis 30, such that the stand fan 10 can be placed on the floor steadily.

Figure 8:
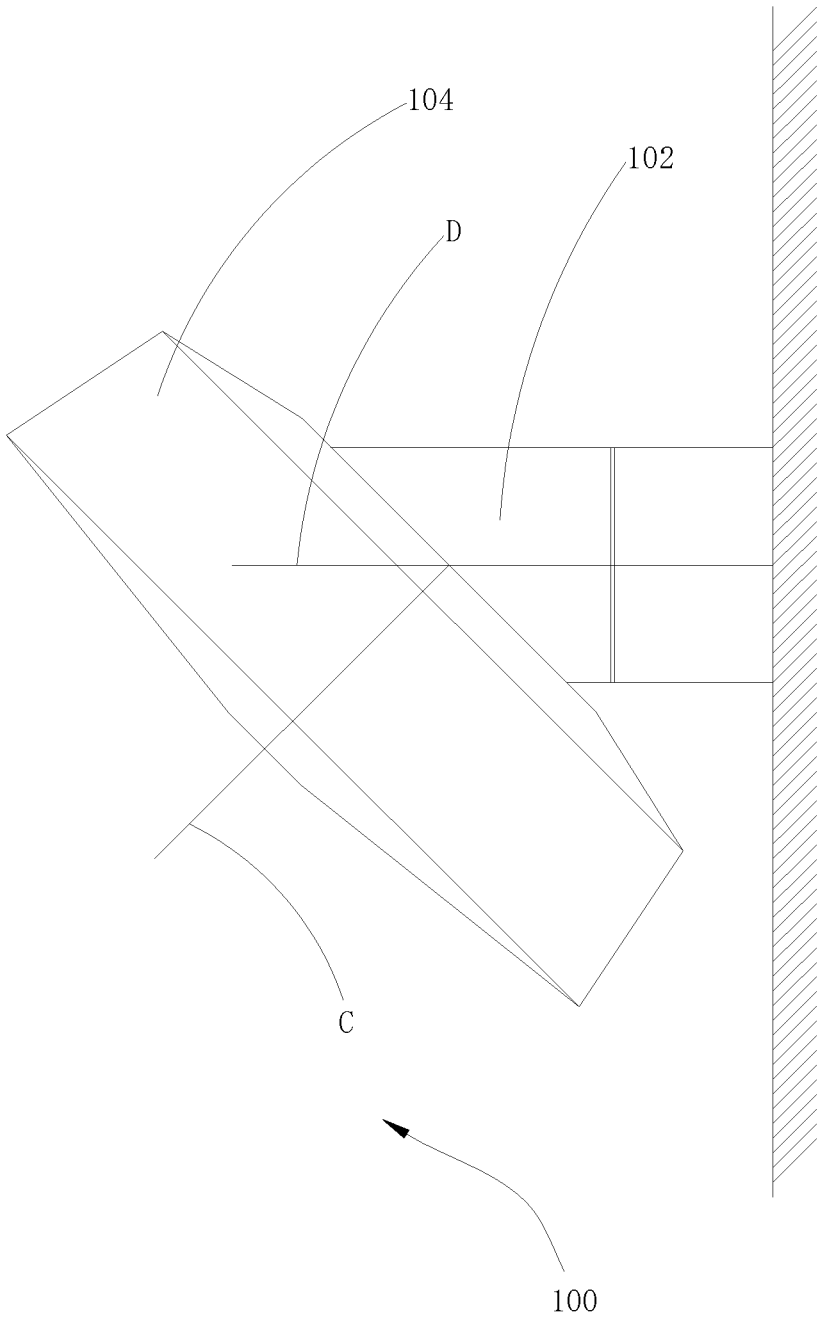
FIG. 8 is a schematic view of a wall-mounted fan according to embodiments of the present disclosure.

Referring to FIG. 8, a wall-mounted fan 100 according to a second embodiment of the present disclosure includes a base 102 and a fan head 104. The fan head 104 includes a blade, a grill and a first rotating shaft C. The first rotating shaft C is used for driving the blade to rotate, the fan head 104 can integrally rotate about a rotating axis D and along a circumferential direction relative to the base 102. The rotating axis D extends through the grill and is obliquely arranged relative to the first rotating shaft C. During installation, the rotating axis D is perpendicular to a wall surface.

In this way, the first rotating shaft C is obliquely arranged relative to the rotating axis D, such that just one drive structure can drive the fan head 104 to rotate in a space defined by a horizontal direction and a vertical direction, the structure is simple and the cost is low.

A specific rotation mechanism of the fan head 104 of the wall-mounted fan 100 according to the second embodiment of the present disclosure can refer to the stand fan 10 in the first embodiment of the present disclosure, which will not be elaborated herein.

Figure 9:
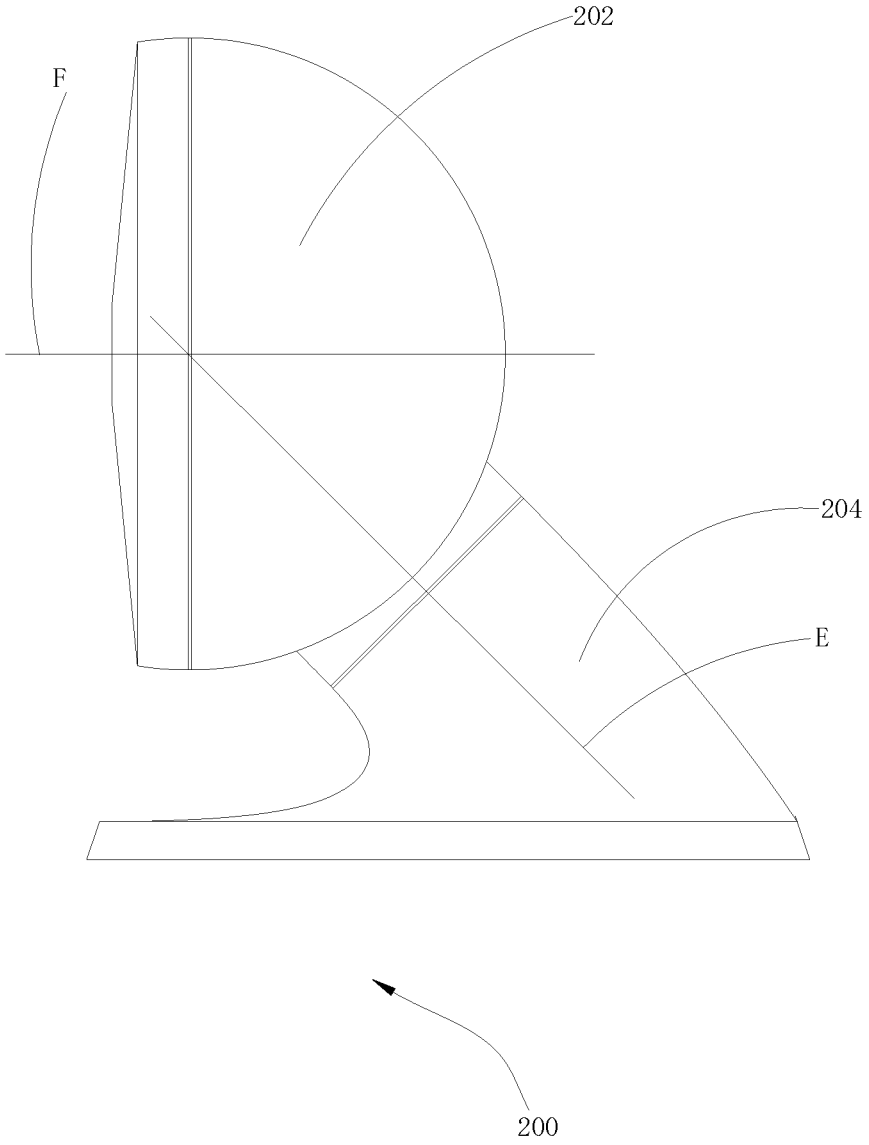
FIG. 9 is a schematic view of a turbo fan according to embodiments of the present disclosure.
Figure 10:
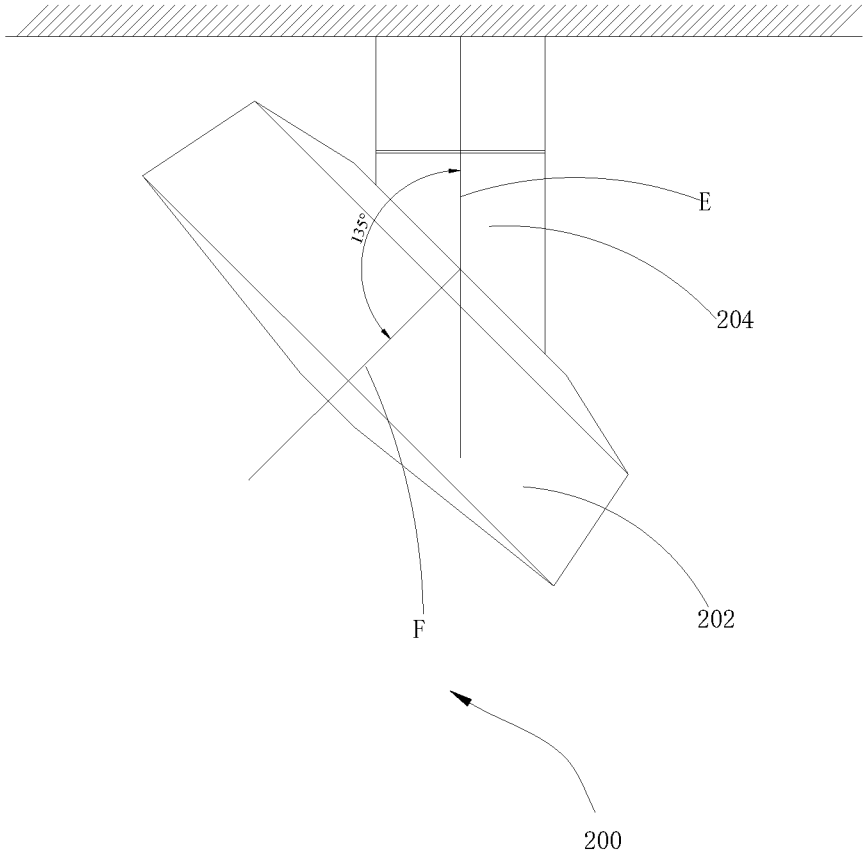
FIG. 10 is a schematic view of a ceiling fan according to embodiments of the present disclosure.

Referring to FIGS. 9 and 10, a household appliance 200 according to embodiments of the present disclosure includes a movable portion 202 and a fixing portion 204. The movable portion 202 includes a grill. The movable portion 202 can integrally rotate about a rotating axis E and along a circumferential direction relative to the fixing portion 204.

The rotating axis E extends through the grill and is obliquely arranged relative to a central line F of the grill of the movable portion 202. The household appliance 200 is not provided with an independently automatic swing mechanism.

In this way, the central line F of the grill of the movable portion 202 is obliquely arranged relative to the rotating axis E, such that just one drive structure can drive the movable portion 202 to rotate in a space defined by a horizontal direction and a vertical direction, and the structure is simple and the cost is low.

The household appliance 200 according to embodiments of the present disclosure is not limited to the stand fan 10 of the first embodiment and the wall-mounted fan 100 of the second embodiment, and can also be a stand fan, such as a turbo fan and blower fan, and a wall-mounted fan, such as a ceiling fan. The turbo fan and the ceiling fan are respectively taken as an example in FIGS. 9 and 10 to describe the household appliance 200 according to embodiments of the present disclosure.

An air blowing method for a fan according to embodiments of the present disclosure is provided. The fan includes a fan head 12, the fan head includes a blade 122 and a grill. The air blowing method includes the following steps.

The blade 122 of the fan head 12 rotates about a first axis A, so as to produce air flow.

The fan head 12 integrally rotates along a circumferential direction relative to a second axis B, in which the second axis B extends through the grill in a front-rear direction and is obliquely arranged relative to the first axis A.

In this way, the second axis B is obliquely arranged relative to the first axis A, such that just one drive structure can drive the fan head 12 to rotate in a space defined by a horizontal direction and a vertical direction, and the structure is simple and the cost is low.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A fan head part comprising a base and a fan head, the fan head comprising a blade and a grill, the blade being connected to a first electric motor that drives the blade to rotate about a first axis, the fan head being connected to a second electric motor different from the first electric motor that drives the fan head to integrally rotate about a second axis and along a circumferential direction relative to the base, the second axis extending through the grill in a front-rear direction and being obliquely arranged relative to the first axis, and wherein the second electric motor drives a first gear to move within a second internal gear attached to the base.

2. The fan head part according to claim 1, wherein an angle defined by a front portion of the first axis and a front portion of the second axis is 10° to 80°.

3. The fan head part according to claim 1, wherein the angle defined by a front portion of the first axis and a front portion of the second axis is 35° to 55°.

4. A stand fan comprising a base and a fan head, the fan head comprising a blade, the blade being connected to a first electric motor that drives the blade to rotate about a first axis and the fan head being connected to a second electric motor different from the first electric motor that drives the fan head to integrally rotate about a second axis and along a circumferential direction relative to the base, a front portion of the second axis being upwards oblique relative to a horizontal plane, and wherein the second electric motor drives a first gear to move within a second internal gear attached to the base.

5. A wall-mounted fan comprising a base and a fan head, wherein the fan head comprises a blade, a grill and a first rotating shaft, the first rotating shaft being connected to a first electric motor used for driving the blade to rotate, the fan head being connected to a second electric motor different from the first electric motor that drives the fan head to integrally rotate about a rotating axis and along a circumferential direction relative to the base, the rotating axis extending through the grill and being obliquely arranged relative to the first rotating shaft, and wherein the second electric motor drives a first gear to move within a second internal gear attached to the base.

* * * * *